US005584082A

United States Patent [19]

Crawford et al.

[11] Patent Number: 5,584,082

[45] **Date of Patent: *Dec. 17, 1996**

[54] CONVERTIBLE GURNEY

[75] Inventors: Michael K. Crawford; Joseph M. Crawford; James R. Crawford, all of Houston, Tex.

[73] Assignee: Easy Lift Care Products, Inc., Houston, Tex.

[ * ] Notice: The term of this patent shall not extend beyond the expiration date of Pat. No. 5,402,544.

[21] Appl. No.: 241,723

[22] Filed: May 12, 1994

Related U.S. Application Data

[63] Continuation-in-part of Ser. No. 123,601, Oct. 17, 1993, Pat. No. 5,402,544.

[51] Int. Cl.[6] ..... A61G 7/16; A61G 7/14; A61G 7/015

[52] U.S. Cl. ..... 5/86.1; 5/616; 5/618; 297/344.17; 297/354.13; 297/68

[58] Field of Search ..... 5/81.1, 86.1, 616, 5/617, 618, 613; 297/68, 71, 344.17, 354.13

[56] References Cited

U.S. PATENT DOCUMENTS

| | | | |
|---|---|---|---|
| 1,748,784 | 2/1930 | Mierley . | |
| 2,587,068 | 2/1952 | Sanders | 5/81.1 |
| 2,682,913 | 7/1954 | Scheide | 5/618 |
| 2,694,437 | 11/1954 | Glaser | 297/83 |
| 2,869,614 | 1/1959 | Wamsley . | |
| 2,913,738 | 11/1959 | Wise . | |
| 3,147,039 | 9/1964 | Smith et al. | 297/90 |
| 3,284,093 | 11/1966 | Engelmeier | 280/46 |
| 3,344,445 | 10/1967 | Crawford | 5/81.1 |
| 3,406,772 | 10/1968 | Ahrent et al. . | |
| 3,967,328 | 7/1976 | Cox | 5/81.1 |
| 4,190,913 | 3/1980 | DiMatteo et al. | 5/81.1 |
| 4,255,823 | 3/1981 | Boyer et al. | 5/81.1 |
| 4,285,541 | 8/1981 | Onishi | 5/81.1 |
| 4,361,917 | 12/1982 | Wilson | 5/616 |
| 4,381,571 | 5/1983 | Elliott | 5/616 |
| 4,432,359 | 2/1984 | James | 5/81.1 |
| 4,453,732 | 6/1984 | Assanah et al. | 5/81.1 |
| 4,717,169 | 1/1988 | Shaffer | 297/DIG. 4 |
| 4,726,082 | 2/1988 | DiMatteo et al. | 5/81.1 |
| 4,787,104 | 11/1988 | Grantham | 5/81.1 |
| 4,839,933 | 6/1989 | Plewright et al. | 5/81.1 |
| 4,856,123 | 8/1989 | Henderson et al. | 5/81.1 |
| 4,858,260 | 8/1989 | Failor et al. | 5/618 |
| 4,966,379 | 10/1990 | Mulholland | 280/250.1 |
| 4,997,200 | 3/1991 | Earls | 5/81.1 |
| 5,048,133 | 9/1991 | Iura et al. | 5/81.1 |

*Primary Examiner*—Alexander Grosz
*Attorney, Agent, or Firm*—Bush, Moseley, Riddle & Jackson, L.L.P.

[57] ABSTRACT

A convertible gurney (10) has an outer fixed support frame (12) which includes a pair of side frames (16) connected by lower horizontal cross frame members (30). An inner frame (14) includes a base (84) and hinged segments (42, 46 and 48) which define rear, seat and leg segments. Inner frame (14) is positioned between the side frames (16) and removably connected thereto by four fasteners (90). A detachable manual operator (170) is mounted on a selected side frame (16) opposite a bed (36) for a patient and effects movement of the segments (42, 46, 48) between gurney and chair positions by operation of a hand crank (184). Each side frame (16) has a foldable side panel (190) which may be utilized in transfer of a patient between a bed (36) and the convertible gurney (10). A patient is first positioned on a hard transfer board (36) as shown in FIGS. 9 and 10 and moved with the transfer board (36) across the side panel (190) forming a bridge between the bed (36) and the convertible gurney (10). An embodiment shown in FIGS. 11–13 provides a pair of separate leg frames (51A, 53A) to permit individual movement of a selected leg frame (51A, 53A).

27 Claims, 9 Drawing Sheets

FIG. 6
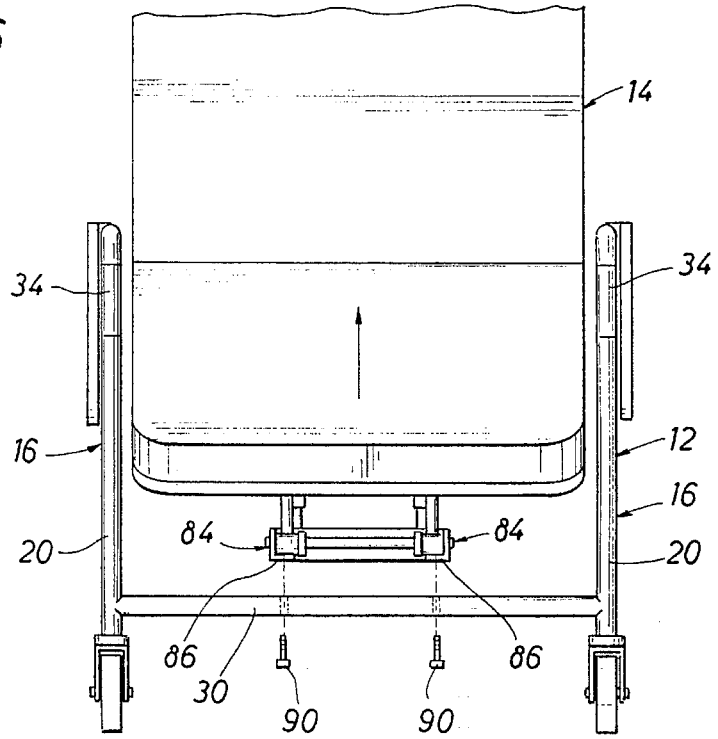
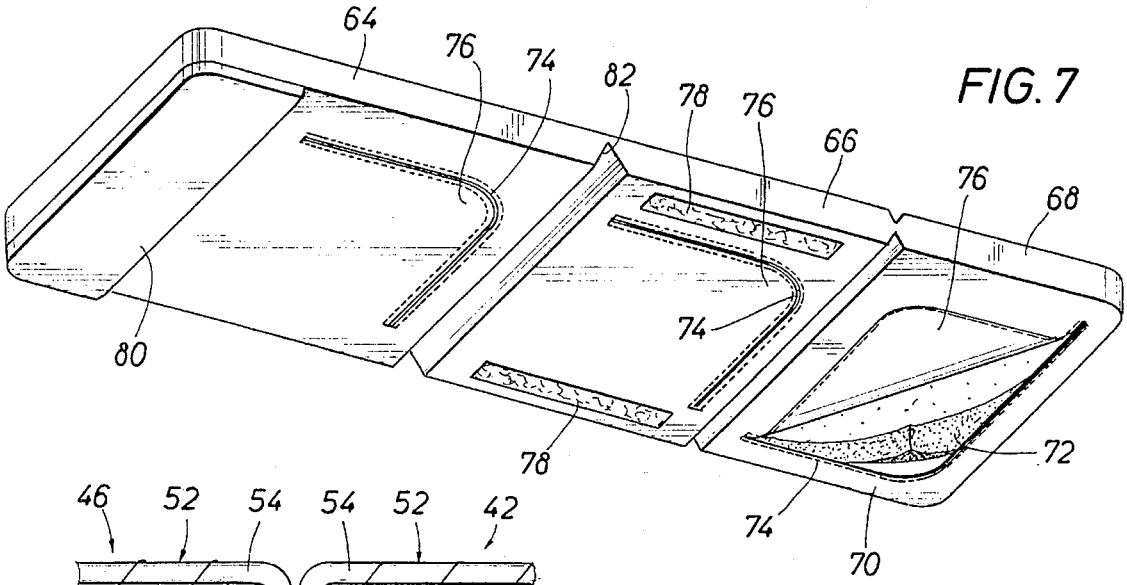
FIG. 7
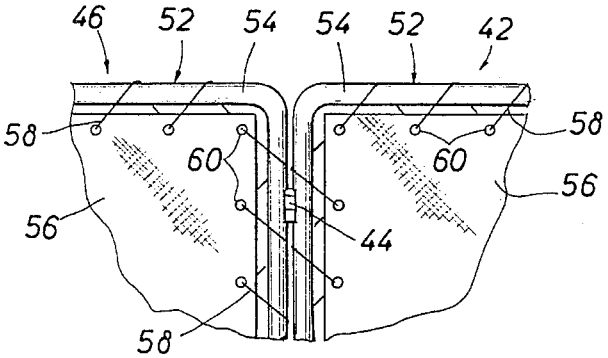
FIG. 8

FIG.11
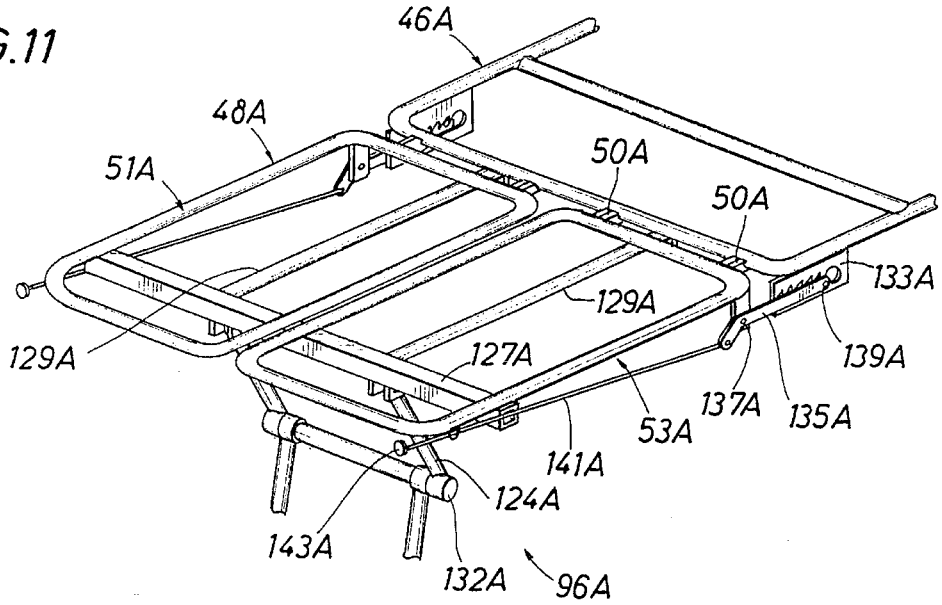
FIG.12
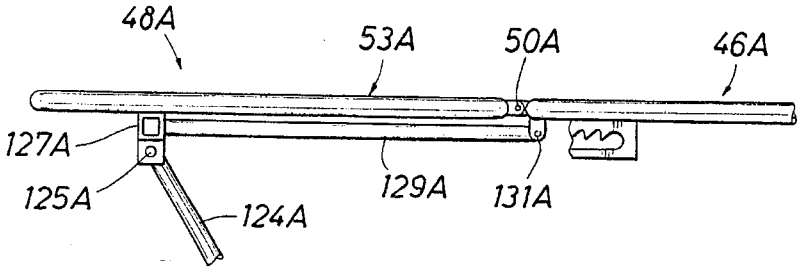
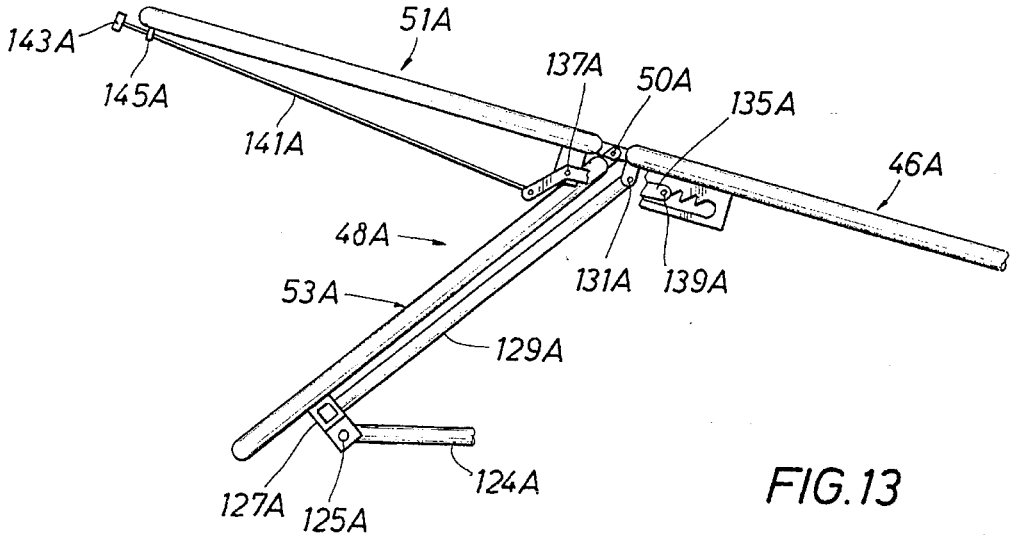
FIG.13

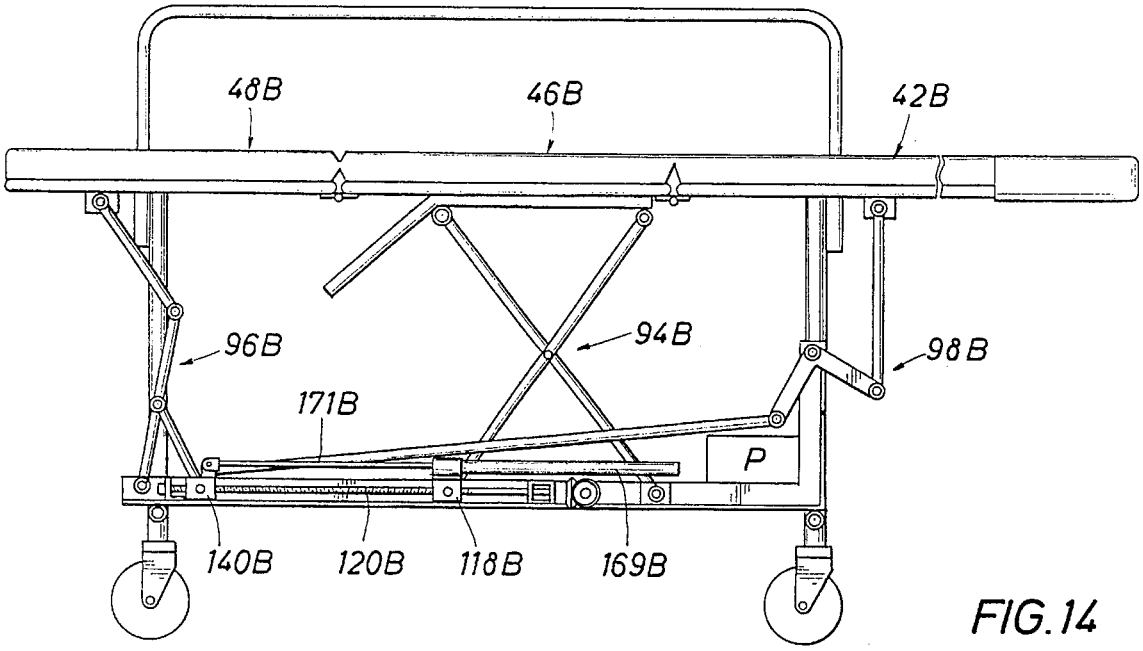
FIG. 14
FIG. 15
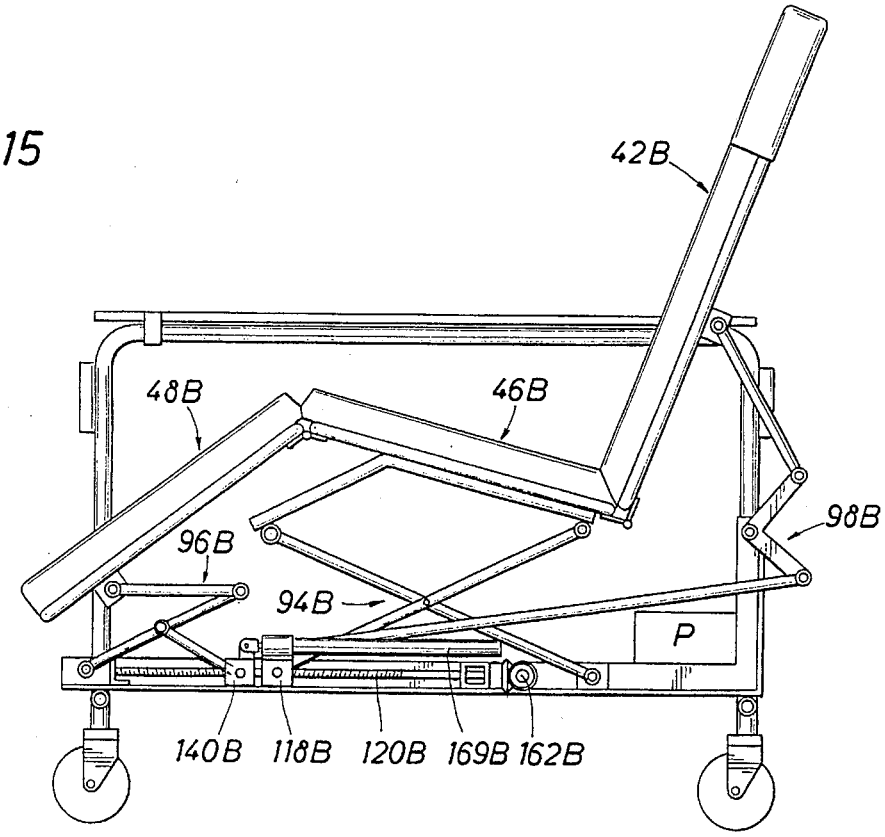

CONVERTIBLE GURNEY

REFERENCE TO RELATED APPLICATION

This application is a continuation in part of application Ser. No. 08/123,601 filed Sep. 17, 1993 and entitled "Combined Chair and Gurney", now U.S. Pat. No. 5,402,544.

FIELD OF THE INVENTION

This invention relates to a gurney for patients in hospitals, nursing homes, or similar health care facilities, and more particularly to a mobile gurney which is easily converted into a chair for transport of the patient.

BACKGROUND OF THE INVENTION

There are currently more than twenty-five million citizens in the United States who are temporarily or permanently totally disabled. These people reside in nursing homes, hospitals, rehabilitation facilities or in homes where they are totally dependent upon the care of others for their survival. Most of these millions of disabled persons are bladder and/or bowel incontinent and are forced to wear diapers or comparable items to contain their urine and excreta. Many of these people suffer from Alzheimers disease or other dementia and are unable to assist or only partially assist in their own care or handling.

Many are confined to bed unless removed from their beds by attending persons. The typical method of removing a disabled person from a bed is to raise the disabled person to a sitting position, rotate the patient to a sitting position on the side of the bed and with an attendant under each arm and an attendant standing and facing the patient, stand or pick the patient up and then turn and lower the patient into a chair, wheelchair, geriatric chair, or on to some other conveying mechanism.

In a typical nursing home, hospital, rehabilitation facility or in the home environment, the disabled incontinent person must have diaper changes at least every two hours and possibly several times an hour for hygiene, as well as prevention of skin irritation and prevention of bed sores. To accomplish a diaper change for any purpose, it is necessary for the attendants to take the disabled person to a bed, lift the disabled person from the wheelchair, geriatric chair, or other seating arrangement, place the person on the bed, change the diaper, and reverse the procedure to return the disabled person to the original seating arrangement. The result of physically handling disabled persons is that many older people sustain spontaneous bone fractures, muscle and ligament pulls or tears, or pain solely from the physical handling and lifting. Another direct consequence of the existing practice outlined above is that the attendants suffer high incidents of injuries to their backs, muscles or ligaments as a result of physically lifting disabled persons from sitting positions onto beds and returning them to their sitting positions. This consequence usually requires that institutions pay the highest workman's compensation insurance rates, and are required to hire additional attendants to perform the lifting and handling of disabled persons. In the home environment the consequence is that the disabled person is essentially confined to bed.

Thus, the problem is that millions of disabled persons in institutions or at home are being moved from beds to chairs or other appliances by the physical strength of their attendants with resulting injuries both to the patient and attendants; or the patient is never or seldom moved from the bed, with resulting bed sores, bad hygiene and circulatory problems. Such problems have greatly increased the cost of care of disabled persons through high insurance costs, additional labor, injuries and litigation.

Heretofore, a combined chair and gurney has been provided. For example, U.S. Pat. No. 2,587,068 dated Feb. 26, 1952 shows a combined chair and gurney which is convertible from a chair to a gurney at the same height as a bed or operating table for transfer if desired. A frame supporting the patient is mounted for pivotal movement between various positions on a lower support frame mounted between wheels or casters. The seat supporting the patient remains in a horizontal position at all times and can not be inclined. Also, side frames are not provided alongside the seat at all times for support of the patient.

U.S. Pat. No. 3,147,039 dated Sep. 1, 1964 likewise shows a combined wheelchair and gurney which is convertible for transport of a patient either in a sitting or lying position. A pair of side frames are provided to support a linkage for converting the transportation of a patient between a sitting position and a lying position. The back seat frame and the leg seat frame are both connected to and supported by the opposed side frames, and the seat frame remains positioned horizontally at all times.

SUMMARY OF THE INVENTION

The present invention is directed to a convertible gurney on wheels or casters which is easily changed by an attendant into a chair which is the same height as a patient bed. The chair is designed to allow a disabled patient to be slipped or turned from the surface of the bed onto the chair in its gurney position, then gently lowered into an infinitely adjustable sitting and/or reclining position. When the disabled person needs a diaper change or other services, the attendant simply and easily raises the disabled person to the horizontal gurney position, changes the patient's diaper or performs other needed medical, physical or hygienic requirements, and then simply and easily lowers a patient to a desired sitting or reclining position.

Patients benefit from use of the convertible chair because they are never physically lifted by attendants with the possible resulting injuries, and the patients can be kept much cleaner because of the ease and frequency with which they can be administered. In addition, patients benefit because they frequently move, thereby eliminating pressure points which cause bed sores. A post-operative patient also benefits from the changing sitting/reclining/horizontal positions in that the circulatory system of the patient is exercised by a frequent, yet gentle movement.

The present invention provides a mobile transport device for a patient convertible between a chair with the patient in a seated position and a gurney with the patient in a supine or prone position. The mobile transport device includes an outer support frame having a pair of parallel side frames connected by cross members, and an inner support frame mounted between the side frames on the cross member. The inner support frame includes three generally planar segments hinged to each other to define an intermediate seat segment and opposed end segments defining a back segment and a leg segment for supporting a patient thereon. Linkages on the inner support frame are connected to the segments for moving the segments between a lowermost seated position defining a chair with the segments in an inclined position and an uppermost position with the segments in an aligned horizontal position to define a gurney for supporting the patient in a prostrate position. Various other positions between the lowermost and uppermost positions may be preselected according to the desire of the patient or assistant.

The inner support frame, which includes the three hinged support segments, easily fits within the outer support frame which includes the pair of side frames supported on rollers. Actuating means for movement of the linkages comprises drive nuts on an externally threaded power screw. The drive nuts are mounted on the drive screw for movement in opposite directions and each linkage is operatively connected to a drive nut for movement therewith. One of the drive nuts is operatively connected to the seat segment, and the other drive nut is operatively connected to the leg and back segments for movement thereof. A manual operator is detachably mounted on a selected side frame and operatively connected to the power screw for selective rotation of the screw and movement of the linkages and associated segments between the lowermost and uppermost positions of the hinged segments. A patient is transferred from a bed to a gurney in a prostrate position. For this purpose the chair is convertible into a gurney with the segments in an aligned horizontal position and the gurney is positioned alongside the bed for transfer of the patient. The manual operator is positioned on the side frame of the gurney opposite the bed and includes a handle positioned above the side frame so that the handle is easily accessible for moving the transport device between various positions.

To assist in transfer of a patient in a prostrate position between the bed and the gurney, a foldable side panel is mounted on each side frame. A rigid transfer board is positioned beneath the patient to support the patient for movement between the bed and gurney. To bridge the space between the bed and gurney for transfer of the board and patient, the side panel on the side frame adjacent the bed is folded outwardly over the bed and lowered onto the bed for support. Then the patient who has been positioned on the rigid board is slipped or moved with the board across the side panel onto the gurney.

An object of the invention is to provide a mobile transport device for a patient which is convertible between a gurney with the patient in a prostrate position and a chair with the patient in a seated position.

Another object of this invention is to provide a mobile gurney convertible into a chair with the gurney positioned from either side thereof alongside a bed for transfer of a patient in a prostrate position between the bed and the gurney.

A further object of this invention to provide such a mobile gurney and chair in which an inner frame, including three hinged segments defining leg, seat, and back segments for a patient, is removably mounted for hinged movement between a pair of side frames forming an outer support frame.

An additional object of this invention is to provide such a mobile transport device in which actuating means for moving the leg, seat, and back segments between a chair position in which a patient is seated and a gurney position in which the patient is prostate may be manually operated from either side of the transport device.

A still further object is to provide such a gurney for transfer of a patent in prostrate position from a bed onto the bed in which a bridge spans the space between the bed and the gurney to permit sliding of a patient over the bridge between the gurney and the bed.

Another object is the provision of a detachable manual operator for moving the transport device between gurney and chair positions, and accessible by an attendant from a position above the outer side of the transport device with the manual operator being detachably mounted adjacent a predetermined side of the transport device.

Other objects, features, and advantages of the invention will be apparent from the following specification and drawings.

BRIEF DESCRIPTION OF THE DRAWINGS

FIG. 6 is an end elevation showing the inner frame removed from the outer frame upon removal of connecting bolts;

FIG. 7 is a perspective of the bottom of the pad which supports the patient on the convertible gurney in a cushioned relation;

FIG. 8 is a plan of a portion of the hinged segments showing a backing for supporting the pad shown in FIG. 7;

FIG. 11 is a perspective of a modification of the present invention showing the leg segment of the convertible gurney divided into two separate leg frames for individual movement of a selected leg;

FIG. 12 is a side elevation of the leg segment shown in FIG. 11 in the gurney position;

FIG. 13 is a side elevation of the leg segment of FIG. 11 in a chair position with one of the leg frames in a raised position;

FIG. 14 is a side elevation of another embodiment of the present invention in a gurney position and showing fluid power means comprising a single acting fluid cylinder for moving the segments between the gurney position and chair position;

FIG. 15 is a side elevation of the convertible gurney shown in FIG. 14 in a chair position;

DESCRIPTION OF THE INVENTION

Figure 1:
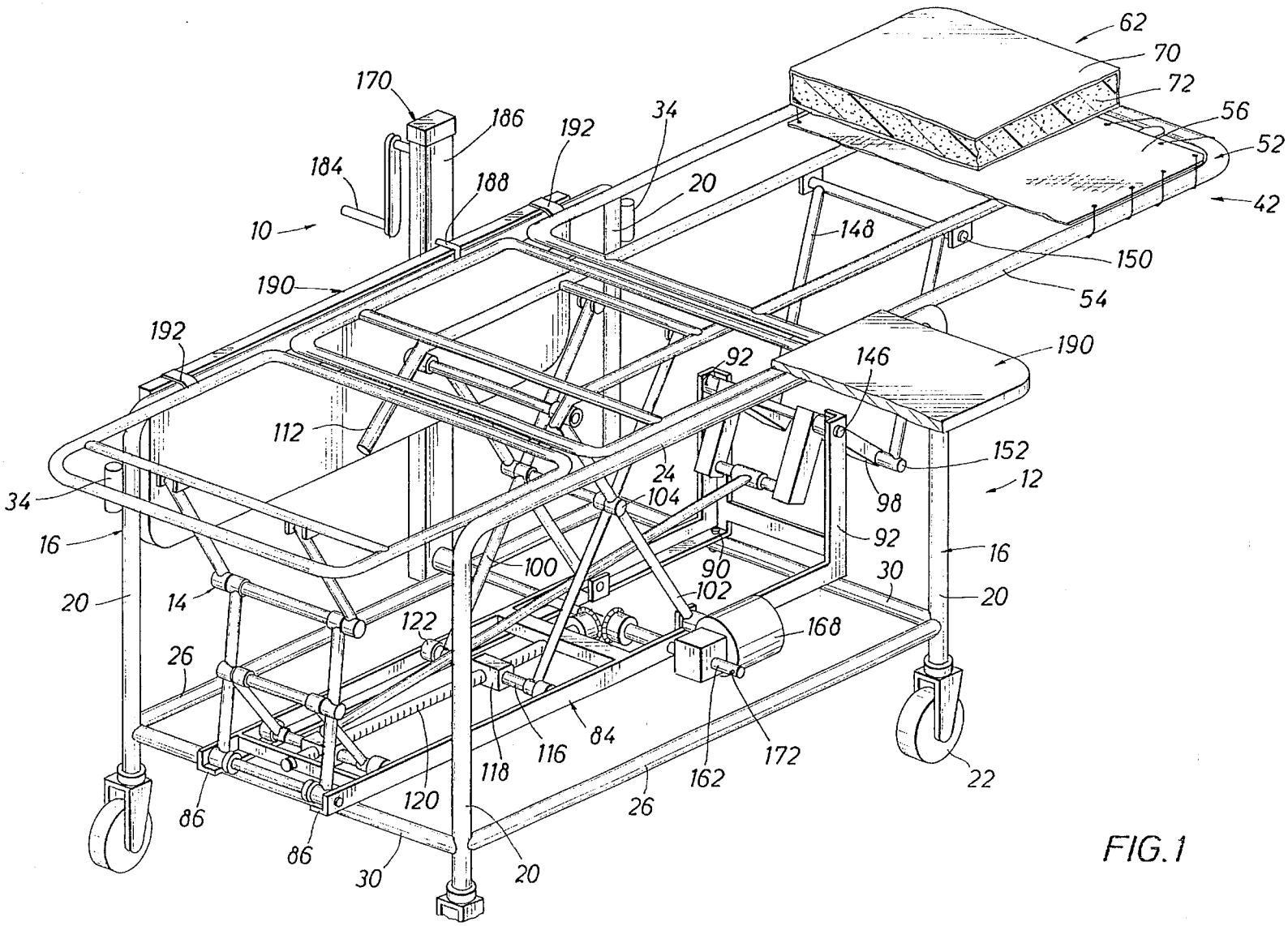
FIG. 1 is a perspective of the convertible gurney of the present invention with certain parts broken away and showing the device being utilized as a gurney to support a patient in a supine position.

Referring now to the drawings for a better understanding of the invention, and more particularly to the embodiment of the invention shown in FIGS. 1–10, the convertible gurney is shown generally at 10 to provide a mobile transfer device for a patient. Gurney 10 convertible into a chair includes an outer support frame indicated at 12 and an inner frame generally indicated at 14. Inner frame 14 is supported on outer fixed frame 12 for pivotal movement between several positions as explained below. Outer frame 12 includes a pair of opposed vertical side flames 16.

Each vertical side frame 16 has a pair of corner vertical frame members or posts 20 with a supporting wheel 22 pivotally connected to the lower end of each frame member 20 to permit gurney 10 to be easily moved or pushed along a supporting surface to define a mobile transport device for a patient. The term "wheel" as used in the specification and claims is intended to include casters, rollers, and other similar turning, rotating, or revolving members. Each side frame 16 has horizontally extending upper and lower frame members 24, 26 extending between corner frame members 20. Lower horizontal frame members 30 extend between the opposed side frames 16 and provide a lower support for inner movable frame 14.

Figure 2:
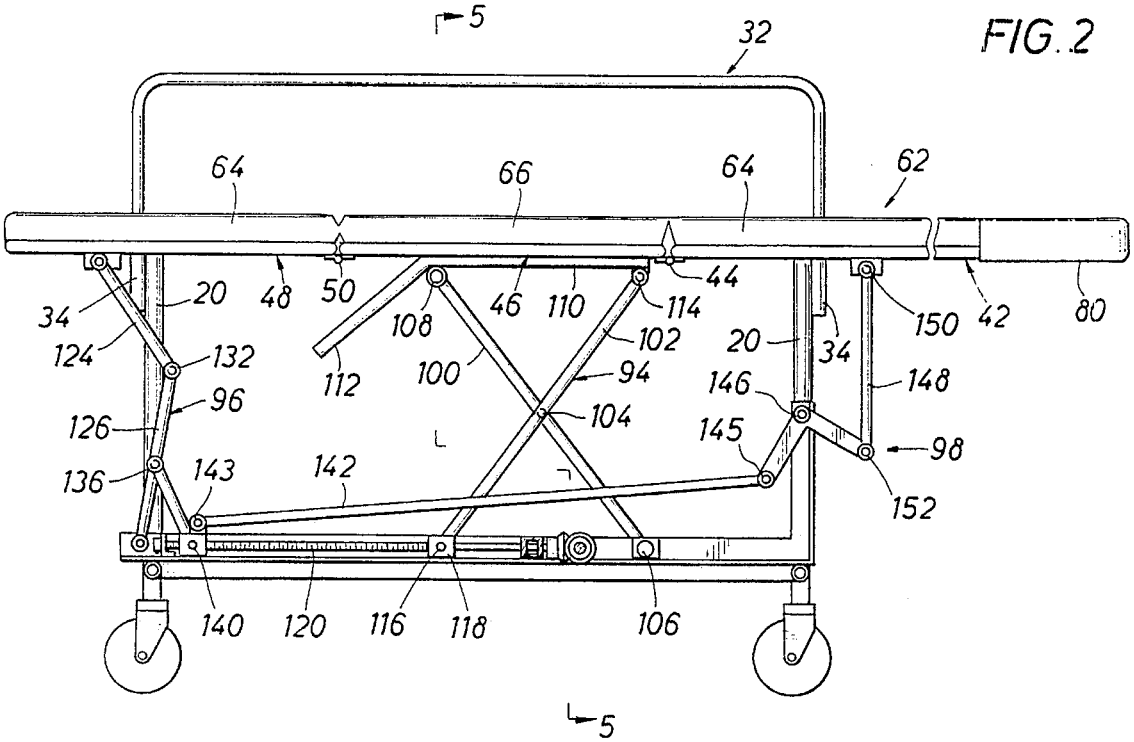
FIG. 2 is a side elevation with one side frame removed showing the convertible gurney of FIG. 1 where the patient may be supported in a supine position and showing a side extension adapted to be removably connected to a side frame for restricting lateral movement of the patient.

A removable upper side frame extension is shown generally at 32 in FIG. 2 and has lower prongs which may be inserted within openings in the upper ends of corner tubular support members 34 secured to the upper ends of posts 20 for selected positioning of upper side frame extension 32. Upper side frame extension 32 restrains lateral movement of the patient particularly when the mobile transport device is utilized as a gurney with the patient in a supine position. A single upper side frame extension 32 or a pair of upper side frame extensions 32 may be provided as desired.

Figure 4:
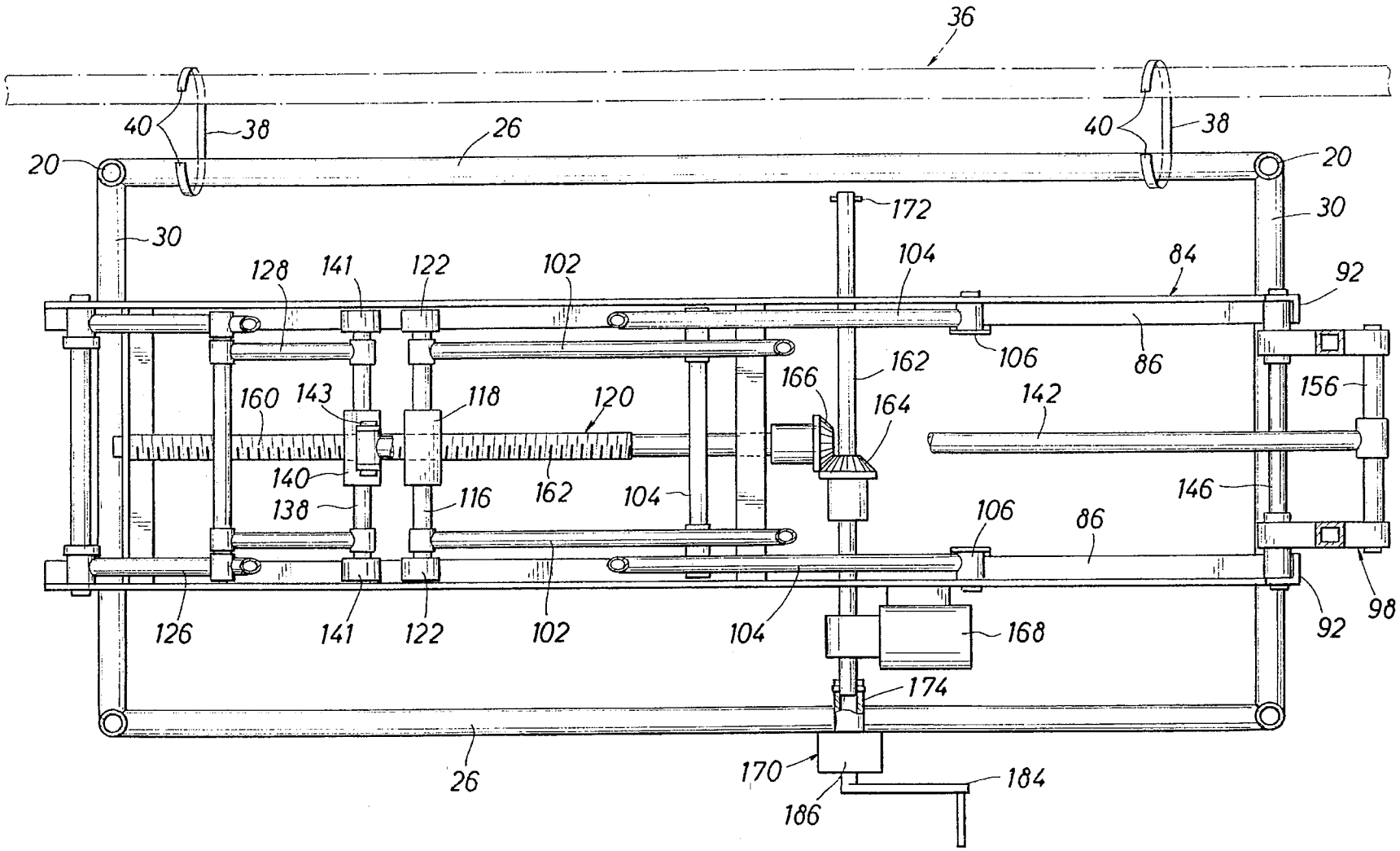
FIG. 4 is a sectional view of the convertible gurney taken generally along line 4—4 of FIG. 3.

At times, a patient may be moved between the gurney and an adjacent operating table or bed as shown partially by a longitudinally extending member of bed 36 in FIG. 4. To insure that the gurney and bed frame do not move away from each other during patient transfer, a strap or elastic bungee cord shown at 38 having end securing means such as hooks 40 may be utilized to releasably connect gurney 10 to bed 36. Similar straps could, if desired, be used for releasably securing adjacent corner posts 20 to adjacent bed 36.

Inner frame 14 includes three hinged segments for supporting the patient. A rear back segment indicated at 42 is hinged at 44 to intermediate seat segment 46. A leg support segment 48 is hinged at 50 to intermediate seat segment 46. Each segment 42, 46, 48 has a generally rectangular base support frame 52 formed of connected tubular members 54 as shown particularly in FIG. 8. Tubular frame members 54 preferably are fabricated from stainless steel. A backing layer 56 preferably of a material formed of a marine type nylon has grommets 58 through which suitable string ties 60 are threaded and wrapped tightly and secured about frame members 54 for maintaining base or backing layer 56 in a taut relation. A separate backing layer 56 is provided for each segment 42, 46 and 48 as shown in FIG. 8.

Figure 3:
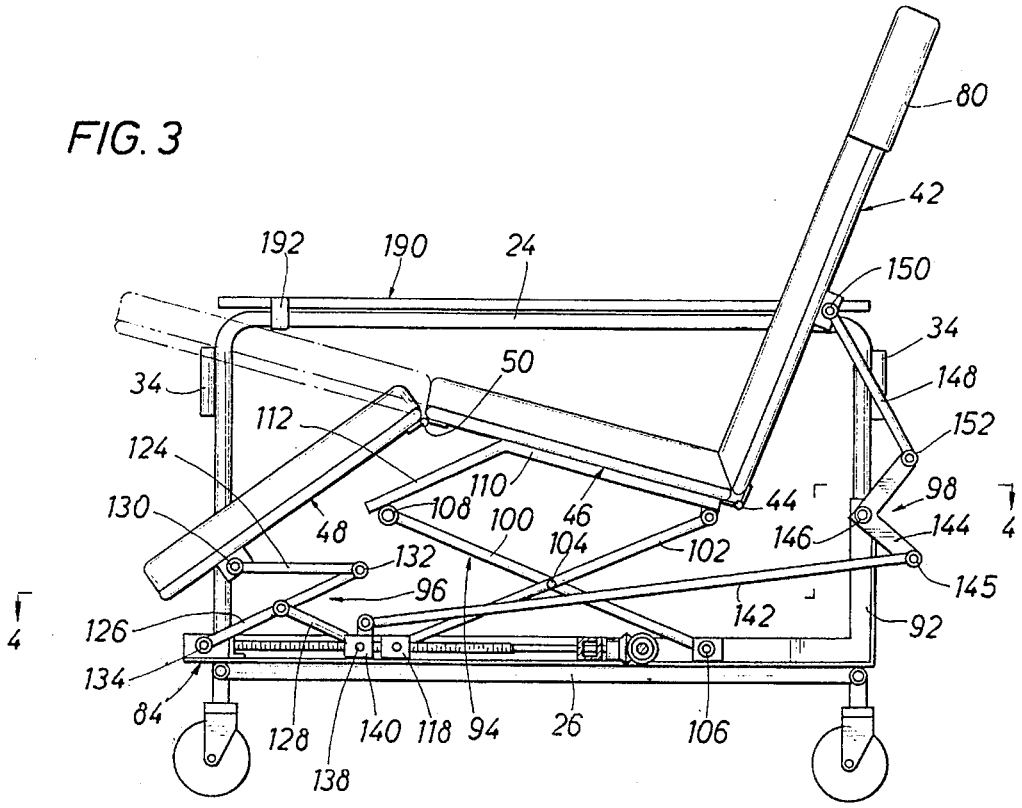
FIG. 3 is a side elevation similar to FIG. 2 but showing the gurney converted into a chair for seating of a patient.

Referring to FIG. 7 particularly, a pad for fitting over segments 42, 46 and 48 is shown generally at 62 and has three hinged or articulated sections 64, 66 and 68 adapted to be positioned over respective segments 42, 46 and 48. Pad 62 has an outer cover 70 formed preferably of a marine type vinyl or polyvinylchloride (PVC) material and a resilient cushion or pillow as shown at 72 is positioned within each section 64, 66 and 68. As illustrated for section 68, a portion of outer cover 70 is zippered at 74 to form a foldable flap 76. When flap 76 is opened, cushion 72 may be inserted and flap 76 secured by zippering to a closed position. Cushion 72 may, for example, be formed of a polyurethane material to provide cushioned support. Intermediate section 66 has a pair of Velcro strips 78 which are releasably secured to backing layer 56 of intermediate segment 46 to provide interlocking hook and loop connections. Section 64 has a pocket 80 adapted to fit over an end of frame 52 for back segment 42 as shown in FIGS. 2 and 3. Thus, pad 62 may be easily mounted over segments 42, 46 and 48 by slipping pocket 80 over frame 52 of back segment 42 and then securing Velcro strips 78 to backing layer 56. Sections 64 and 68 may slip relative to subjacent segments 42 and 48 upon hinged movement of segments 42, 46 and 48 to various desired positions. The hinged connection of pad 62 between sections 64 and 66 includes a hinge formed of a V-shaped cutaway 82 on the bottom surface of pad 62. Thus, any possible pinching of the patient during movement of segments 42 and 46 is prevented. Also, no seams are provided on the upper surface of pad 62 as all stitching for cover 70 is along the side edges or bottom of cover 70. Cover 70 is waterproof and may be easily washed and cleaned.

Inner frame 14 includes a base 84 supporting segments 42, 46 and 48. Base 84 has a pair of longitudinal members 86 with bottom flanges 88 bolted to cross members 30 of outer fixed frame 12 by nut and bolt combination 90. Base 32 includes upstanding vertical end members 92 integral with longitudinal member 86. As shown particularly in FIGS. 5 and 6, inner frame 14 may be positioned between side frames 16 with base 84 supported on cross members 30 and then connected to outer fixed frame 12 by the assembly of four nut and bolt combinations 90 for securing flanges 86 to cross members 30. Inner frame 14 may be disconnected from fixed frame 12 in a similar manner.

Linkages as shown generally in FIGS. 2 and 3 generally designated 94 and 96 support respective segments 46 and 48. A separate linkage generally designated 98 supports back support segment 42. Linkage 94 includes two pairs of links or rods 100 and 102 pivotally connected to each other about a shaft at 104. Links 100 have lower ends pivotally connected at 106 to base 84 and have rollers 108 at their upper ends. Tracks or guides 110, FIGS. 2 and 3, are secured to the lower surface of seat segment 46 and have end portions 112 extending angularly from seat segment 46. Rollers 108 are mounted for riding along track end portions 112 from the lowermost position shown in FIG. 3 to the uppermost position shown in FIG. 2. Links 102 have upper ends pivoted at 114 to seat support segment 46 and lower ends pivotally connected to a shaft 116 secured to opposite sides of a drive nut 118 in threaded engagement with an externally threaded power screw 120. Shaft 116 has rollers 122 on opposite ends thereof which are supported on and ride along base 84 as shown particularly in FIGS. 1 and 4.

Linkage 96 has two pairs of links or rods 124, 126, and 128. Links 124 have upper ends pivotally connected at 130 to leg support segment 48 and lower ends pivotally connected to links 126 at 132. Links 126 are pivotally connected adjacent their lower ends at 134 to base 84. Links 128 are pivotally connected adjacent their upper ends at 136 to links 126 and pivotally connected adjacent their lower end to a shaft 138 secured to opposite sides of a drive nut 140 in threaded engagement with externally threaded power screw 120. Shaft 138 has rollers 141 on opposite ends thereof which are supported on and side along base 84. While drive nuts 118, 140 are shown as supported by horizontal shafts 116, 138, it is to be understood that drive nuts 118, 140 may be supported by other means such as a vertically extending support, for example. Drive nuts 118, 140 may be fabricated by threading a brass bar, for example.

Linkage 98 includes a push rod 142 connected at 143 to nut 140 and connected at 145 to bell crank 144. Bell crank 144 is pivotally mounted on shaft 146 which is supported on vertical members 92 of base 84. A pair of links 148 are pivotally mounted at 150 to back support segment 42 and at 152 to bell crank 144. If desired, an eccentric may be substituted for bell crank 144. Also, a yoke may, if desired, be secured to the end of push rod 142 and mounted at its lower end to shaft 138 connected to nut 140.

Upon rotation of power screw 120, drive nuts 118 and 140 move in opposed directions for actuation of linkages 94, 96 and 98. For that purpose, power screw 120 as shown in FIG. 4 has a right hand screw thread 160 for drive nut 140 and a left hand screw thread 162 for drive nut 118. A drive shaft 162 has a bevel gear 164 engaging bevel gear 166 on an end of power screw 120 for rotation of power screw 120. To position drive nuts 118 and 140 at a desired spaced relation on power screw 120, drive nut 118 is first threaded on screw 120, and then nut 140 is threaded on screw 120 to obtain the desired spaced relation. For further details of drive nuts 118, 140, reference is made to application Ser. No. 08/123,601 now U.S. Pat. No. 5,402,544.

Figure 5:
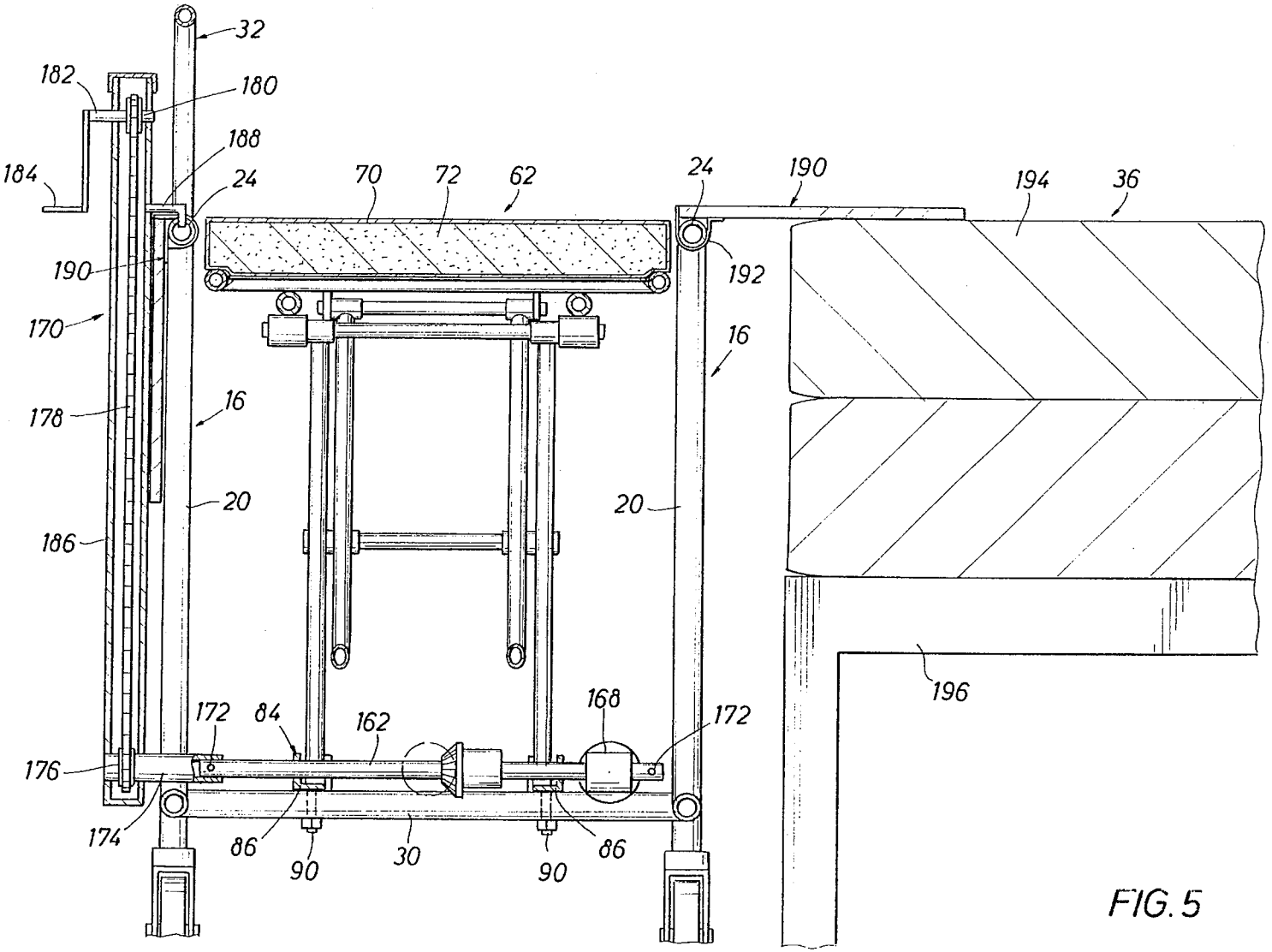
FIG. 5 is a sectional view taken generally along line 5—5 of FIG. 2 and showing a side panel folded to a generally horizontal position and supported by the bed for transfer of a patient between the bed and gurney.

As shown particularly in FIGS. 4 and 5, drive shah 162 is rotated optionally from an electric motor 168 and suitable gearing connected to drive shaft 162. Motor 162 may be battery operated or powered from a source of a.c. voltage (not shown). Suitable controls (not shown) may be mounted on outer fixed frame 12 for control. Optionally, a detachable manually operated drive unit or operator generally indicated at 170 is illustrated for connection to a selected end of drive shaft 162 from the side of gurney 10 opposite bed 36 as shown particularly in FIG. 5. Each end of shaft 162 has a drive pin 172 adapted to engage a slotted tube 174 projecting from unit 170 and having a sprocket 176 thereon. Slotted tube 174 receives an end of shaft 162 and drive pin 172 in driving relation. A sprocket chain 178 extends between lower sprocket 176 and upper sprocket 180. Sprocket 180 is mounted on shaft 182 having a hand crank 184 for rotation of drive shaft 162. A rectangular housing 186 extends about sprockets 176, 180 and sprocket chain 178 and an upper hook 188 extends from housing 170. Hook 188 is adapted to fit within an opening in upper frame member 24 of adjacent side frame 16.

For transferring manual drive unit 170 from one side of gurney 10 to the other side. slotted tube 174 is pulled outwardly and unit 170 is then lifted upwardly to remove hook 188 from the opening in upper frame member 24. Then, hook 188 is received within an opening in upper frame member 24 of the opposed side frame 16 for support of unit 170, and slotted tube 174 is then pushed inwardly to engage drive pin 172 in driving relation. Thus, manual drive unit 170 can be transferred in a minimum of time from one side of gurney 10 to the other side of gurney 10.

Figure 9:
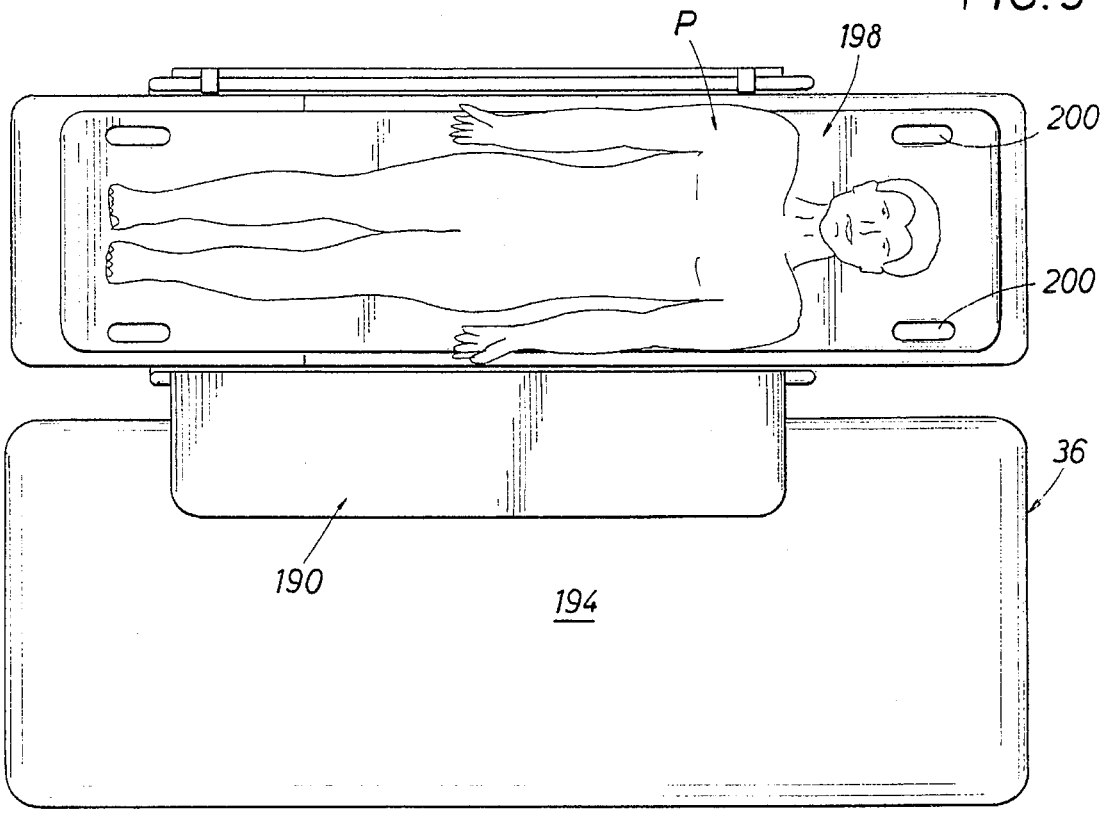
FIG. 9 is a plan view showing the gurney of the present invention alongside a bed with a patient on a rigid transfer board supported on the gurney for transfer between the gurney and bed.
Figure 10:
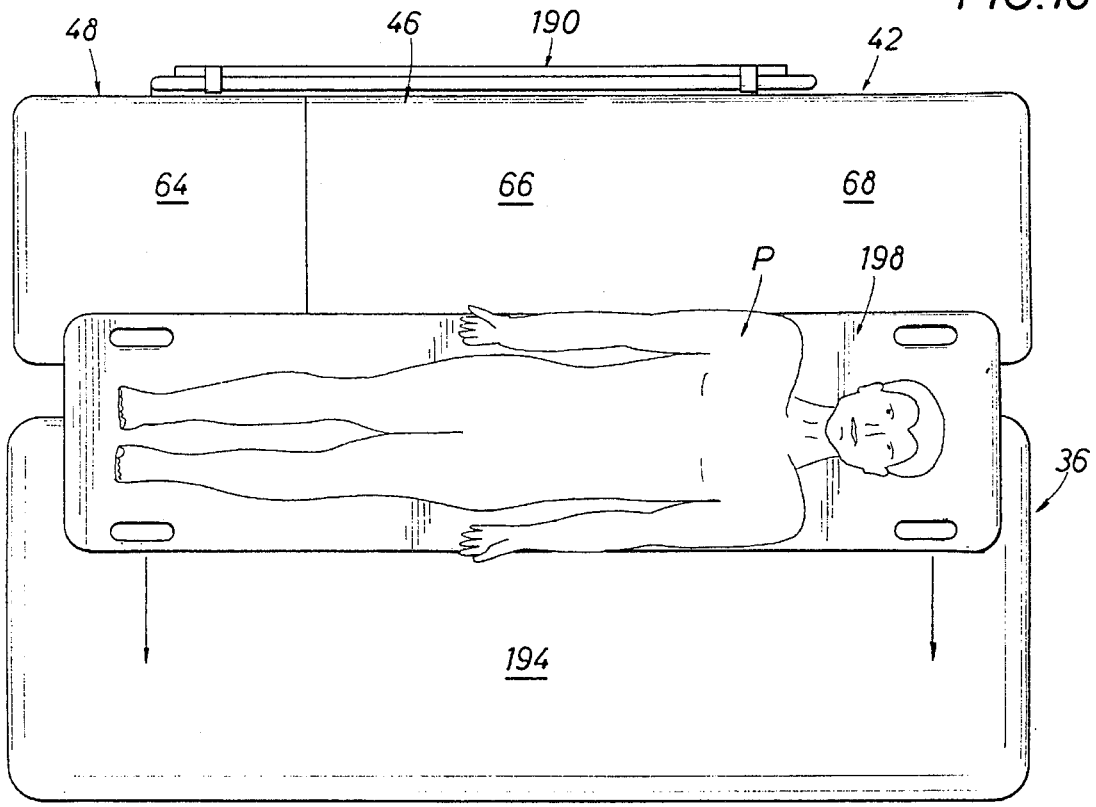
FIG. 10 is a plan view similar to FIG. 9 but showing the transfer board with the patient thereon being transferred over a side panel between the bed and gurney.

Patients are often transferred or moved between a gurney and a bed or operating table. It is desirable that a patient not be lifted during this transfer as possible injuries may occur to some patients during lifting. A lateral sliding or rolling movement of the patient is preferred in lieu of any lifting of the patient. To provide a bridge between gurney 10 and a bed as shown generally at 36 in FIG. 5, a foldable side panel or shelf is shown at 190 mounted on the upper frame member 24 of each side frame 16 and a width sufficient to span the spacing between bed 36 and side frame 16. A plurality of metal bands 192 secured to each side panel 190 are mounted about the associated upper frame member 24 for folding or pivotal movement of side panel 190. As shown in FIG. 5, bed 36 has an upper mattress 194 supported on bed frame 196. To provide a bridge between mattress 194 and gurney 10, side panel 190 adjacent mattress 194 is first folded upwardly above mattress 194, and is then lowered onto mattress 194 for support as shown in FIG. 5 with side panel 190 being generally at the same level as the patient support surface of gurney 10 when in a gurney position. Manual drive unit 170 is positioned on the side of gurney 10 opposite bed 26. In this position, a patient P as shown in FIGS. 9 and 10 may be transferred.

For transfer of patient P, a rigid transfer board shown generally at 198 is provided having hand holds 200. Transfer board 198 may, for example, be formed of a rigid polyethylene plastic material around ¾ inch in thickness and of dimensions generally greater than the dimensions of patient P. Transfer board 198 is first slipped under patient P by an attendant, and then the patient P is moved on transfer board 198 laterally across side panel 190 by the gripping of hand holds 200 by the attendant. Thus, patient P is transferred without any lifting.

As illustrated particularly in FIGS. 5 and 6, segments 42, 46, 48 are not supported on or connected to side frames 16 and may move vertically and horizontally relative to side frames 16. Segments 42, 46 and 48 are supported on base 34 mounted on cross frame members 30. Thus, inner frame or subassembly 14 may be preassembled with the associated drive means and then positioned within outer frame 12 with base 34 secured to cross members 30 by four nut and bolt combinations 90.

As shown in FIG. 3, convertible gurney 10 has been converted into a chair and seat support segment 46 is inclined to provide comfortable seating for the patient. The amount of inclination may be varied depending on the desires of the patient. Since seat segment 46 is below the uppermost position of side frames 16 when in an inclined position, side frames 16 extend upwardly above seat segment 46 and provide a restraint against lateral movement of the patient.

The uppermost gurney position is shown in FIG. 2. Drive nuts 118 and 140 are closely spaced to each other in FIG. 3, whereas in FIG. 2 the drive nuts 118 and 140 are spaced a maximum distance from each other. As a result of the right hand thread 160 for nut 140 and the left hand thread 162 for nut 118 as shown in FIG. 4, rotation of power screw 120 moves nuts 118 and 140 in opposite directions. Upon rotation of power screw 120 from the position shown in FIG. 3, nuts 118 and 140 move away from each other with rollers 108 moving along tracks 112 to tilt or incline seat segment 46 upwardly to the position shown in FIG. 2 in which rollers 108 on the ends of links 100 are in an uppermost position with segments 42, 46, and 48 in a horizontal position to support a patient in a supine or prostrate position. The inclination of seat segment 46 gradually changes from the inclination shown in FIG. 3 to the horizontal position shown in FIG. 2. Back segment 42 is pulled downwardly by push rod 142 and bell crank 144 to the position of FIG. 3 upon movement of nut 140 from the position of FIG. 3 to the position of FIG. 2.

As illustrated in FIG. 3, when seat segment 46 is fully lowered, the rear edge of seat segment 46 at hinge 44 is substantially lower than the front edge of segment 46 at hinge 50 thereby giving the patient a seat which is tilted rearwardly as in a lounger or swivel chair. As seat segment 46 is lowered from the gurney position shown in FIG. 2, back segment 42 simultaneously tilts downwardly along hinge 44 upon movement of push rod 154. Linkage 96 upon movement of nut 140 from the position of FIG. 3 to the position of FIG. 2 is extended for lifting leg segment 48 to the horizontal position of FIG. 2. Side frames 16, particularly upper frame members 24 thereof, provide a lateral restraint to keep the patient from rolling or falling off mobile transport device 10. Side panels 190 may also be useful when in a chair position to form a support for trays or other implements to be supported thereon.

Pad 62 is positioned over segments 42, 46 and 48 by first slipping pocket 80 over the upper end of back support 42 and then securing Velcro strips 78 to backing layer 56 for seat segment 46. This permits slipping of pad sections 64 and 68 relative to respective segments 42 and 48 as segments 42, 46 and 48 are moved between chair and gurney positions. Cover 70 may be easily cleaned and has no stitching or seams on its upper surface thereby to provide patient comfort with a smooth surface for any relative movement of the patient.

It is desirable at times, particularly when in a chair position, for the patient to have one leg raised while the other leg is lowered. For that purpose and referring to FIGS. 11–13, a separate embodiment of the invention is illustrated in which leg segment 48A hinged to seat segment 46A about hinges 50A is separated into two separate leg frames 51A and 53A which may be actuated individually if desired. Thus, either leg frames 51, 53A may be raised and lowered relative to the other leg frame. Linkage 94A similar to linkage 94 of the embodiment of FIGS. 1–10 has links 124A pivotally connected at 125A to a cross support member 127A which supports leg frames 51A and 53A. Upper links 129A pivotally connect cross support member 127A to seat segment 46A at 131A. As shown in FIGS. 11 and 12, leg frames 51A and 53A are shown in a gurney position with both leg frames 51A and 53A in a raised horizontal position.

FIG. 13 shows seat segment 46A and leg segment 48A in the chair position with leg frame 51A raised. Leg frame 51A is raised manually from cross support member 127A. For that purpose and to maintain leg frame 51A in a raised position, seat segment 46A for each leg frame 51A, 53A has a fixed notched retaining member 133A secured thereto. A releasable cooperating retaining lever is shown at 135A and is pivotally mounted at 137A to each leg frame 51A and 53A. A pin 139A on each lever 135A is adapted to releasably engage a selected notch in retaining member 133A. A suitable push rod 141A pivotally mounted to lever 135A has a manually actuated button 143A on the extending end of push rod 141A. Lever 135A is normally disengaged from retaining member 133A as lever 135A is normally urged for gravity to a disengaged position. A ring 145A receives push rod 141A and upon pushing of rod 141A to the latched engaged position of lever 135A as shown in FIG. 13, indentations on push rod 141A receive ring 145A for releasably mounting leg frame 51A in raised position. To release leg frame 51A, rod 141A is moved upwardly to remove the indentation from ring 145A and then pulled outwardly to pivot lever 135A and pin 139A out of engaged position to permit manual lowering of leg frame 51A to the position of leg frame 53A as shown in FIG. 13.

Referring now to FIGS. 14 and 15, another embodiment of this invention is illustrated in which fluid power means is utilized for movement of the back, seat and leg segments between the gurney position shown in FIG. 14 and the chair position shown in FIG. 15. Segments 42B, 46B, 48B and associated linkages 94B, 96B, 98B are generally similar to segments 42, 46, 48 and linkages 94, 96, 98 of the embodiment shown in FIGS. 1–10. A single acting fluid cylinder shown at 169B is secured to nut 118B and has a piston rod 171B connected to nut 140B. Fluid is supplied to cylinder 169A from pump P and a suitable reservoir (not shown). Power screw 120A is provided with double helix threads including right hand and left hand threads similar to power screw 120. Nuts 140B and 118B move simultaneously along power screw 120B upon the supply and exhaust of fluid from cylinder 169B. Drive shaft 162B similar to drive shaft 162 is provided and may be manually rotated independently of fluid cylinder 169A as in the embodiments of FIGS. 1–10.

Figure 16:
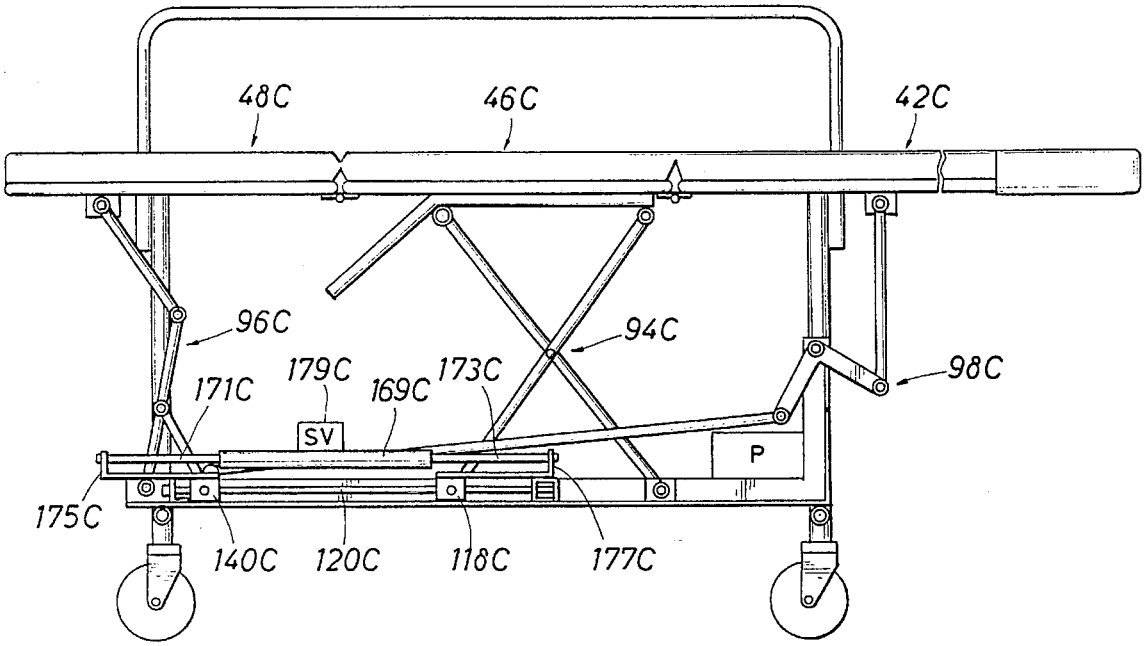
FIG. 16 is a side elevation of a further embodiment of the present invention in a gurney position and showing fluid power means comprising a double acting cylinder for moving the segments between a gurney position and a chair position.
Figure 17:
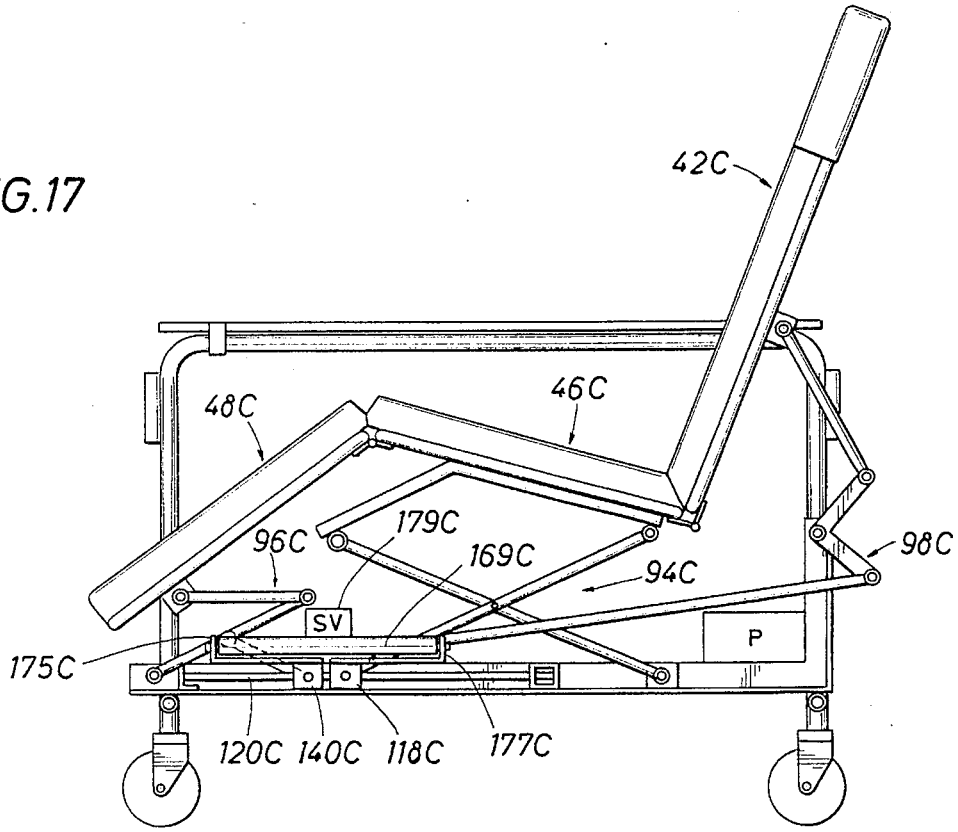
FIG. 17 is a side elevation of the embodiment of FIG. 16 showing the convertible gurney in a chair position.

Referring now to FIGS. 16 and 17, a further embodiment of a fluid power screw is illustrated in which a double acting cylinder is utilized for movement of the back, seat and leg segments between the gurney position shown in FIG. 16 and the chair position shown in FIG. 17. Segments 42C, 46C, 48C and associated linkages 94C, 96C, and 98C are generally similar to segments 42, 46, 48 and linkages 94, 96, 98 of the embodiment of FIGS. 1–10. Double acting cylinder 169C has pistons 171C and 173C extending therefrom. Piston 171C is secured to bracket 175C which is connected to nut 140C and piston 173C is connected to bracket 177C which is connected to nut 118C. A sensor valve 179C is connected to piston 169C so that equal sliding movement of nuts 118C and 140C is obtained along slide rod 120C which is unthreaded. If desired, rod 120C could be threaded in a manner similar to power screw 120. A separate manual operation of linkages 94C, 96C and 98C is not provided in the embodiment of FIG. 16 and 17. However, if desired, a separate manual operation independently of double acting cylinders 169C could be provided.

Upon a supply of fluid from pump P to double acting cylinder 169C in the position of FIG. 17, piston rods 171C and 173C are extended to move nuts 118C and 140C along slide rod 120C to the extended position of FIG. 16 in which segments 42C, 46C and 48C are in a gurney position.

The term "supine" as used herein is the position in which the back part of the body is supported whereas the term "prone" as used herein is the position in which the front part of the body is supported. The term "prostrate" as used herein is the position in which a person lies in a flat position either in a prone or supine relation. A patient on a gurney 10 which is converted into a chair would be in supine position. However, a patient transferred between a bed and a gurney could be either in a prone or supine position.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A mobile transport device (10) adapted to be positioned alongside an adjacent bed (36) for a patient to permit the patient to be moved sidewise between the bed and the transport device; said device comprising:

a fixed outer support frame (12) including a pair of side frames (16) supported on wheels for movement;

a movable inner support frame (14) supported by said fixed outer side frames (16) and movable between a chair portion for seating a patient and a gurney position for supporting the patient in a prostrate relation; and a side panel (190) on the upper end of at least one fixed side frame (16) mounted for folding movement between a generally horizontal position extending laterally outwardly from said fixed side frame and a generally vertical position extending alongside said side frame.

2. A mobile transport device (10) as set forth in claim 1 wherein said side panel (190) when in a generally horizontal position has a width sufficient to adequately span the spacing between the bed (36) and side frame (16), and an outer marginal side portion (FIG. 5) adapted to extend a substantial distance over an adjacent bed and to be supported thereby to permit a patient to be moved sidewise over said panel and said side frame (16) for positioning on said inner support frame (14).

3. A mobile transport device (10) as set forth in claim 1 wherein a second side panel (190, FIGS. 1 and 6) is provided on the upper end of the other side frame (16) and mounted for movement between a generally horizontal position extending laterally outwardly from said other side frame (16) and said wheels, and a vertical position extending alongside said side frame (16).

4. A mobile transport device (10) as set forth in claim 3 wherein when said mobile transport device is positioned alongside an adjacent bed (36), the adjacent panel (190) is folded to a generally horizontal position and has an outer marginal side portion (FIG. 5) extending over and supported on said adjacent bed (36) to permit a patient to be moved sidewise over the adjacent panel (190) and side frame for positioning on said inner support frame (14).

5. A mobile transport device (10) as set forth in claim 1 wherein a plurality of lower cross members (30) extend between and connect the lower ends of said side frames (16) to each other and said inner support flame (14) is supported on said cross members (30) between said side flames (16); and means (90) detachably connect said inner support frame (14) to said cross members (30) to permit detachment of said inner support frame (14) from said side flames (16).

6. A mobile transport device (10) as set forth in claim 1 wherein said inner support frame (14) includes three generally planar segments (42, 46, 48) hinged to each other to define an intermediate seat segment (46) and opposed end segments defining a back segment (42) and a leg segment (48) for supporting a patient thereon.

7. A mobile transport device (10) as set forth in claim 6 wherein actuating means (170) supported on said side frames (16) is operatively connected to said inner support frame (14) for moving said segments (42, 46, 48) between a position defining a chair (FIG. 3) with said segments in an inclined position relative to each other to support the patient in a seated position and a position (FIG. 2) defining a gurney with said segments aligned horizontally to support a patient in supine relation.

8. A mobile transport device as set forth in claim 7 wherein said actuating means (170) includes a manually operated drive means (170) having a crank (184) positioned alongside the other side frame (16) for manual operation.

9. A mobile transport device (10) for a patient convertible between a chair with the patient in a seated inclined relation and a supine position of the patient; said device comprising:

an outer support frame (12) including a pair of generally parallel side frames (16) supported on wheels (22) for movement;

a plurality of cross members (30) extending between and connecting said side frames (16) to each other;

an inner support frame (14) mounted on said cross members (30) between said side frames (16) of said outer support frame (12) and including three generally planar segments (42, 46, 48) connected to each other to define an intermediate seat segment (46) and opposed end segments defining a back segment (42) and a leg segment (48) for supporting a patient thereon;

means (94, 96, 120) including a linkage assembly (94, 96) between said outer support frame (12) and said segments (42, 46, 48) mounted on said cross members (30) for raising said hinged segments (42, 46, 48) between a lower position defining a chair (FIG. 3) with said segments in an inclined position relative to each other and an upper position (FIG. 2) defining a gurney with said segments (42, 46, 48) aligned horizontally to support a patient in supine relation; said segments (42, 46, 48) moving upwardly relative to said side frames (16) during movement between said lower and upper positions;

power means (120, 168, 170) operatively connected to said linkage assembly (94, 96) for actuating said linkage assembly for movement of said segments (42, 46, 48) between said positions; said linkage assembly (94, 96) including a first linkage (94) between said outer support frame (12) and said intermediate seat segment (46), and a second linkage (96) between said outer support frame (12) and said leg segment (48); and actuating means (120, 162, 168, 170) operatively connected to said first and second linkages (94, 96) for actuating said linkages simultaneously for movement between the lower seated position (FIG. 3) of the patient and the upper supine position (FIG. 2) of the patient for selective positioning at predetermined position of the patient between said lower and upper positions.

10. A mobile transport device as set forth in claim 9 wherein said back segment (42) defines a rear back support for the patient, said back segment (42) being mounted for sliding movement relative to said side flames (16), and means (94, 108) to support said back segment (42) for sliding movement relative to said side frames (16) upon movement of said segment (42) between lower and upper positions.

11. A mobile transport device as set forth in claim 10 wherein said means (94, 108) to support said back segment (42) comprises a plurality of rollers (108).

12. A mobile transport device as set forth in claim 9 wherein said power means (120, 168, 170) includes an externally threaded screw (120) having movable nut means (118, 140) in threaded engagement with said screw (120) and operatively connected to said linkage (94, 96) for movement of said linkage and associated segments (42, 46, 48) between said upper and lower positions upon rotation of said screw (120).

13. A mobile transport device as set forth in claim 12 wherein a hand operated crank (184) is operatively connected to said externally threaded screw (120) for selective rotation of said screw (120) and movement of said segments (42, 46, 48) to a desired position between upper and lower positions thereof.

14. A mobile transport device (10) for a patient convertible between a chair position with the patient in a seated inclined relation and a gurney position with the patient in a supine position; said device comprising:

an outer support frame (12) including a pair of generally parallel side frames (16) supported on wheels (22) for movement;

an inner support frame (14) mounted on said outer support frame (12) and including three generally planar segments (42, 46, 48) hinged to each other to define an intermediate seat segment (46) and opposed end segments defining a back segment (42) and a leg segment (48) for supporting a patient thereon;

linkage means (94, 96, 98) for said inner support frame (14) pivotally connected to said hinged segments (42, 46, 48) for movement of said hinged segments between lower and upper positions;

a generally horizontally extending externally threaded power screw (120) on said inner support frame (14);

internally threaded drive nut means (118, 140) in threaded engagement with said externally threaded screw (120) and operatively connected to said linkage means (94, 96) for actuation of said linkage means (94, 96, 98) and movement of said hinged segments (42, 46, 48); and means (168, 170) for selectively rotating said power screw (120) for moving said nut means (118, 140) along said power screw (120) for raising and lowering said hinged segments (42, 46, 48).

15. A mobile transport device as set forth in claim 14 wherein said linkage means (94, 96) includes a first linkage (94) for said intermediate seat segment (46) and a separate linkage (96) for said leg segment (48), and said drive nut means (118, 140) includes a separate nut for each linkage operatively connected to the associated linkage for raising and lowering the associated segment.

16. A mobile transport device as set forth in claim 15 wherein separate screw threads (160, 162) are provided on said power screw (120) for said nuts (118, 140) so that said nuts move toward and away from each other for actuating said linkages (94, 96) simultaneously.

17. A mobile transport device as set forth in claim 14 wherein said means for selectively rotating said power screw (120) includes a countershaft (162) connected in driving relation to said power screw (120) and a hand operated crank (184) operatively connected to said countershaft (162) for rotation of said countershaft (162) and said power screw (120) thereby to actuate said linkage means (94, 96, 98) for moving said segments (42, 46, 48) between lowered and raised positions.

18. A mobile transport device as set forth in claim 14 wherein said linkage means (94, 96, 98) includes a linkage (96) for said leg segment (48) adjacent one end of said inner support frame (14) and a linkage (98) for said back segment (42) adjacent the other end of said inner support frame (14), and said drive nut means (118, 140) includes a nut (140) threaded on said screw (120); said nut (140) operatively connected to said linkages (96, 98) for said leg segment (48) and back segment (42) for effecting simultaneous movement of said leg and back segments (48, 42) upon rotation of said screw (120) and movement of said nut (140) along said screw.

19. A mobile transport device as set forth in claim 18 wherein a push rod (142) extends between said drive nut (140) and said linkage (98) for said back segment (42) for effecting movement of said back segment (42) and a separate link arm (128) extends from said drive nut (140) for said linkage (96) for said leg segment (48).

20. A mobile gurney (10) for supporting a patient in a supine position convertible into a chair position for supporting the patient in a seated position; said gurney (10) comprising:

a pair of generally parallel outer sides (16);

an inner support assembly (14) mounted on said sides (16) and including three segments (42, 46, 48) connected to each other to define an intermediate seat segment (46) and opposed end segments defining a back segment (42) and a leg segment (48) for supporting a patient thereon;

externally threaded power screw means (120) on said inner support assembly;

a pair of drive nuts (118, 140) mounted on said power screw means (120) for simultaneous movement in opposite directions upon rotation of said power screw means (120); and a separate linkage (94, 96, 98) for each of said segments, the linkage (94) for said seat segment (46) operatively connected to one of said drive nuts (118) for movement, and the linkages (96, 98) for said leg and back segments (48, 42) operatively connected to the other of said drive nuts (140) for simultaneous movement thereof.

21. A gurney as set forth in claim 20 wherein a push rod (142) extends longitudinally between said other drive nut (140) and said linkage (98) for said back segment (42) for effecting movement of said back segment (42).

22. A gurney as set forth in claim 20 wherein each of said drive nuts (118, 140) has a pair of opposed rods (100, 128) secured thereon, and support rollers (122, 141) are mounted on said rods (100, 128) to support said drive nuts (118, 140) on said inner support assembly (14) for relative movement.

23. A gurney (10) as set forth in claim 20 wherein said linkage (94) for said seat segment (46) includes a pair of links (100, 102) pivotally connected to each other and having upper ends for supporting said seat segment (46), the lower end of one of said links (102) being connected to said one drive nut (118) for effecting movement of said seat segment (46).

24. A gurney as set forth in claim 23 wherein the upper end of the other of said links (100) has a roller (108) thereon contacting said seat segment (46) to permit sliding movement of said other link (100) upon movement of said seat segment (46).

25. A gurney as set forth in claim 20 wherein each of said segments (94, 96, 98) is of a hollow rectangular shape defined by a tubular metallic member (54), and a separate fabric backing member (56) is mounted within each of said segments (42, 46, 48) and secured to the surrounding metallic member (54); and a resilient pad (62) comprising three hinged sections (64, 66, 68) is mounted over said segments (42, 46, 48) and removably secured thereto.

26. A gurney as set forth in claim 25 wherein coacting hook and loop strips (78) are provided between said resilient pad (66) and said seat segment (46) for removably mounting said pad (62) thereon.

27. A gurney as set forth in claim 25 wherein each of said hinged segments (64, 66, 68) includes an outer waterproof cover (70) and an inner layer of polyurethane material (72), said cover (70) having an upper surface devoid of seams thereby to present a smooth unobstructed surface.

* * * * *